US005542990A

United States Patent [19]

Nakamura et al.

[11] Patent Number: 5,542,990

[45] Date of Patent: Aug. 6, 1996

[54] CAMSHAFT

[75] Inventors: Yoshikatsu Nakamura; Osamu Kawamura; Teruo Takahashi; Shinichi Yamamoto, all of Tochigi-ken, Japan

[73] Assignee: Nippon Piston Ring Co., Ltd., Japan

[21] Appl. No.: 254,367

[22] Filed: Jun. 6, 1994

[30] Foreign Application Priority Data

Jun. 8, 1993 [JP] Japan ..... 5-137876
Feb. 28, 1994 [JP] Japan ..... 6-054443

[51] Int. Cl.[6] ..... C22C 38/60; C22C 38/00

[52] U.S. Cl. ..... 148/319; 148/323; 148/904

[58] Field of Search ..... 148/904, 323, 148/319; 420/31, 9

[56] References Cited

U.S. PATENT DOCUMENTS 5,028,281 7/1991 Hayes et al. ..... 148/321
5,230,382 7/1993 Swars ..... 164/477

FOREIGN PATENT DOCUMENTS 730867 4/1980 U.S.S.R. ..... 148/904
904753 8/1962 United Kingdom ..... 148/323

*Primary Examiner*—Deborah Yee
*Attorney, Agent, or Firm*—Parkhurst, Wendel & Burr

[57] ABSTRACT

A camshaft made of cast iron containing at least one element selected from the group consisting of Bi, Te, Se, As, Sb and Sn in a total amount of 0.0001 to 0.1 weight %, preferably, 0.001 to 0.1 weight %. The cast iron may further contain at least one element selected from the group consisting of Ni, Cu and Co, in an amount of 0.2 to 5.0 weight %. Furthermore, in the camshaft of the present invention, a carbide area ratio at the sliding surface of the cam lobe portion is not less than 40%, the chilled carbide has an average grain diameter of not more than 15 μm, and the sliding surface of the cam lobe portion has a hardness of not less than HRC 53.

5 Claims, 6 Drawing Sheets

AVERAGE GRAIN DIAMETER
7 μm

AVERAGE GRAIN DIAMETER
10 μm

AVERAGE GRAIN DIAMETER
4 μm

AVERAGE GRAIN DIAMETER
13 μm

AVERAGE GRAIN DIAMETER
8μm

AVERAGE GRAIN DIAMETER
25μm

CAMSHAFT

BACKGROUND OF THE INVENTION

This invention relates to a camshaft and a method of manufacturing the same, and more particularly, to a camshaft capable of being used for a high pressure engine and a method of manufacturing such camshaft effectively with low cost.

In general, as a camshaft for an engine, there is a widely known so-called cast iron chilled camshaft in which a chilled carbide is formed on a sliding surface of a cam portion by rapidly quenching the cam portion by means of a chill.

Recently, in accordance with an improvement of an engine with high performance, there has been required to provide a camshaft for a high pressure engine having high abrasion resistant property and high scuffing resisting property.

However, these properties are not sufficiently attained by the above-mentioned cast iron chilled camshaft. For example, there has been used a remelting chilled camshaft which is formed by irradiating a laser beam onto a once chilled cam portion and then again performing a chilling operation, or a camshaft which is formed of a cast steel or sintered material.

However, in a conventional so-called cast iron chilled camshaft, there exist limitations in refining of the chilled carbide, carbide area rate and hardness of the carbide, so that it is extremely difficult to further improve the abrasion resistant property and the scuffing resisting property more than those in the present technical level.

Furthermore, in the above-described remelting chilled camshaft, an equipment, for example, for performing an irradiation of laser is additionally required, involving a manufacturing cost increasing.

Still furthermore, the above-described camshaft formed of the cast steel or sintered material has a material cost higher than that of the cast iron chilled camshaft, thus also providing a problem.

SUMMARY OF THE INVENTION

An object of the present invention is to provide a camshaft having sufficient abrasion resistant property and scuffing resisting property and having refined carbide composition capable of being utilized for a high pressure engine and to also provide a method of manufacturing a camshaft of the above characters effectively with low cost that does not involve complicated manufacturing equipment.

The camshaft according to the present invention is a camshaft made of cast iron containing chilled carbide to a sliding surface of a cam lobe portion of the camshaft, wherein the cast iron contains at least one element selected from the group consisting of Bi, Te, Se, As, Sb and Sn by an amount of 0.0001 to 0.1 weight %, preferably, 0.001 to 0.1 weight %. At least one element selected from the group consisting of Ni, Cu and Co is further contained in the cast iron by an amount of 0.2 to 5.0 weight %. Furthermore, according to the camshaft of the present invention, as occasion demands, a carbide area rate at the sliding surface of the cam lobe portion is made not less than 40%, or the chilled carbide is made so as to provide an average grain diameter of not more than 15 μm, and furthermore, the sliding surface of the cam lobe portion is made so as to have a hardness of more than HRC 53.

According to such camshaft structure, since at least one element selected from the group consisting of Bi, Te, Se, As, Sb and Sn has a function for promoting the refining of the carbide, the coagulation speed is further increased in comparison with a usual chilling cooling by containing such element in the cast iron, and as a result, the fine chilled carbide is precipitated on the sliding surface of the cam lobe portion. Accordingly, the abrasion resistant property and the scuffing resisting property can be markedly improved. Consequently, it is said that the camshaft formed of a material of cast iron containing at least one kind of elements selected from the group consisting of Bi, Te, Se, As, Sb and Sn by an amount of 0.0001 to 0.1 weight % can realize the sufficient abrasion resistant property and scuffing resisting property.

Furthermore, the camshaft manufacturing method according to the present invention is performed, in a manner in which a molten bath of cast iron is cast in a cast mold having a cavity surface, corresponding to the sliding surface of the cam lobe portion, formed by a chill, then a cast product is taken out of the cast mold, and the cast product is subjected to a finishing working to form a camshaft, and is characterized in that at least one element selected from the group consisting of Bi, Te, Se, As, Sb and Sn by an amount of 0.0005 to 0.5 weight %, preferably, 0.005 to 0.5 weight %, is added to the molten bath. At least one element selected from the group consisting of Ni, Cu and Co is further added to the molten bath by an amount of 0.2 to 5.0 weight %. The molten bath is cast at a casting temperature of 1350° C. to 1400° C.

According to the camshaft manufacturing method of the present invention, since at least one element selected from the group consisting of Bi, Te, Se, As, Sb and Sn is added at a pouring time of the molten bath by an amount of 0.0005 to 0.5 weight %, the refining of the carbide can be promoted. Therefore, according to the camshaft manufacturing method according to the present invention, it becomes possible to manufacture a camshaft having fine carbide composition and also having markedly improved abrasion resistant property and scuffing resisting property effectively with low cost without relying on new equipment for the manufacture of the camshaft.

DESCRIPTION OF THE PREFERRED EMBODIMENTS

Preferred embodiments according to this invention will be described hereunder with reference to the accompanying drawings.

Figure 1:
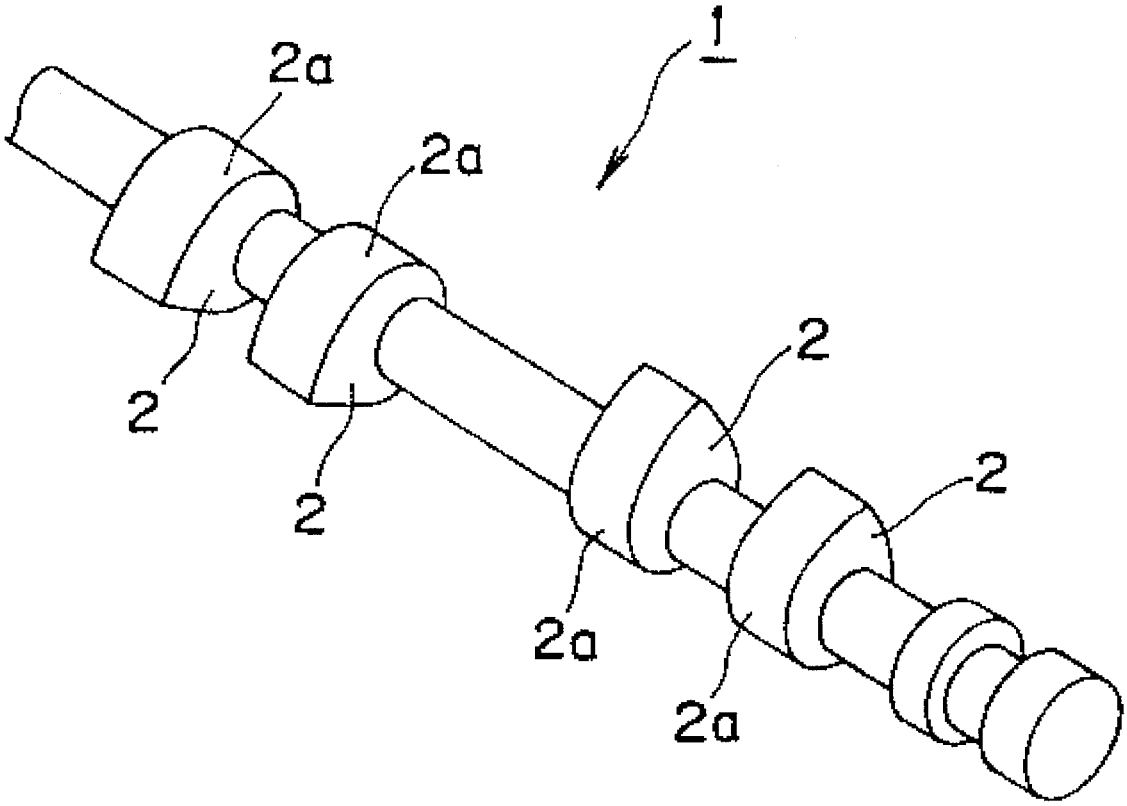
FIG. 1 is a perspective view partially showing one embodiment of a camshaft according to this invention.

A camshaft 1 shown in FIG. 1 is a camshaft formed of a cast iron containing at least one element selected from the group consisting of Bi, Te, Se, As, Sb and Sn of 0.0001–0.1 weight %, preferably, of 0.001–0.1 weight %. Further, it is to be noted that, in the present disclosure, the term "cast iron camshaft" represents a camshaft formed of a cast iron which is formed five elements (C, Si, Mn, P, S) of a cast iron and at least one element (e.g., Cu, Ni, Cr, Mo, B, V or the like) which is added to the above five elements.

The reason for the definition of the content of at least one element mentioned above is as follows.

That is, in a case where the content of at least one element selected from the group consisting of Bi, Te, Se, As, Sb and Sn is less than 0.0001 weight %, there may cause a case where a carbide is not sufficiently refined, and accordingly, the abrasion resistant property and the scuffing resisting property cannot be sufficiently improved. On the other hand, in a case where the content of at least one element selected from the group consisting of Bi, Te, Se, As, Sb and Sn exceeds 0.1 weight %, there may cause a case where a chilled depth may overexceed or a chilled compound may be formed to a non-chilled portion (journal portion), thus being inconvenient.

In an image analysis of a sliding surface of a cam lobe of a camshaft formed of a cast iron containing at least one element selected from the group consisting of Bi, Te, Se, As, Sb and Sn of 0.0001–0.1 weight %, and preferably, of 0.001–0.1 weight %, the rate occupied by the carbide, i.e. carbide area rate, is not less than 40%, preferably, not less than 45%.

In the case of the carbide area rate of less than 40%, the abrasion resistant property and the scuffing resisting property are sometimes not sufficiently improved. The average grain diameter of these carbides is usually not more than 15 μm, and when such average grain diameter exceeds 15 μm, the abrasion resistant property and the scuffing resisting property are sometimes not sufficiently improved.

A hardness of the sliding surface 2*a* of the cam lobe 2 of the camshaft 1 is, in usual, not less than HRC 53, and preferably, not less than HRC 55.

The cast iron forming this camshaft 1 has a composition, as one example, usually containing, in addition to at least one element selected from the group consisting of Bi, Te, Se, As, Sb and Sn, carbon (C), silica (Si), manganese (Mn), chromium (Cr), molybdenum (Mo) and a balance of iron (Fe). Further, in accordance with the shape of the camshaft, the cast iron forming the camshaft may contain, in addition to at least one element selected from the group consisting of Bi, Te, Se, As, Sb and Sn, at least one element selected from the group consisting of Ni, Cu and Co. By containing these elements, a portion such as journal portion to be worked can be prevented from being chilled and a large amount of the precipitation of the carbon can be also prevented.

The content of at least one element selected from the group consisting of Ni, Cu and Co, which may be contained in the cast iron, is within 0.2 to 5.0 weight %. In the case of less than 0.2 weight % of this containing rate, the function and/or effect for preventing the chilling of the portion such as journal portion to be worked and a large amount of the precipitation of the carbon will not sufficiently be achieved.

On the other hand, in the case of more than 5.0 weight % of this containing rate, such function and/or effect will not also be achieved, and in addition to an economical disadvantage, the formation of the fine carbide on the sliding surface of the cam lobe portion will sometimes be obstructed.

The camshaft of the structure described above can be effectively manufactured by the following manner.

First, a cast mold having a cavity surface, corresponding to the sliding surface 2*a* of the cam lobe portion 2, is formed of a chiller is manufactured.

Then, a molten bath of a cast iron additionally containing at least one element selected from the group consisting of Bi, Te, Se, As, Sb and Sn, by an amount of 0.0005 to 0.5 weight %, preferably, 0.005 to 0.5 weight %, is poured into the thus manufactured cast mold. In a case where this additive rate is out of the above range, the content of these elements in the cast iron may be out of the range within 0.0001 to 0.1 weight %, preferably, 0.001 to 0.1 weight %, and accordingly, the improvement of the abrasion resistant property and the scuffing resisting property may not sufficiently be achieved.

The reason why the additive rate is higher than the content is considered that a part of the additive elements evaporate.

The casting temperature of 1350° C. to 1400° C. will be usually employed. In the case of less than 1350° C., a sound cast product may not be manufactured. On the other hand, in the case of more than 1400° C., less carbide may be formed to the cam lobe portion and hence the chilled depth will be small.

Thereafter, the cast product is taken out of the cast mold and a finishing working is effected thereto thereby forming a camshaft 1.

As described above, according to the above-mentioned manufacturing method, any additional new equipment is not required such as in the case of the remelting chilling operation.

Further, in accordance with the shape design desire of the camshaft to be manufactured, it may be preferred to add at least one kind of elements selected from the group consisting of Bi, Te, Se, As, Sb and Sn by an amount of 0.0005 to 0.5 weight % to a molten bath of the cast iron containing at least one element selected from the group consisting of Ni, Cu and Co by an amount of 0.2 to 5.0 weight % for preventing the portion such as journal portion to be worked from being chilled or a large amount of carbide from being precipitated.

The camshafts of the present invention will be further concretely described hereunder with reference to experimental examples and comparative examples.

Experimental Example 1

A camshaft (for gasoline engine four cylinder OHC type) was manufactured by adding bismuth (Bi) by a predetermined amount to a molten bath of cast iron and then casting it into a cast mold having a cavity surface, corresponding to a sliding surface of a cam lobe portion, formed of a chiller at a cast temperature of 1380° C. The thus manufactured camshaft provided a composition in which fine carbide composition is dispersed to the sliding surface of the cam lobe portion.

The composition and the cam hardness (HRC) thus obtained are shown in Tables 1 and 2.

Figure 2:
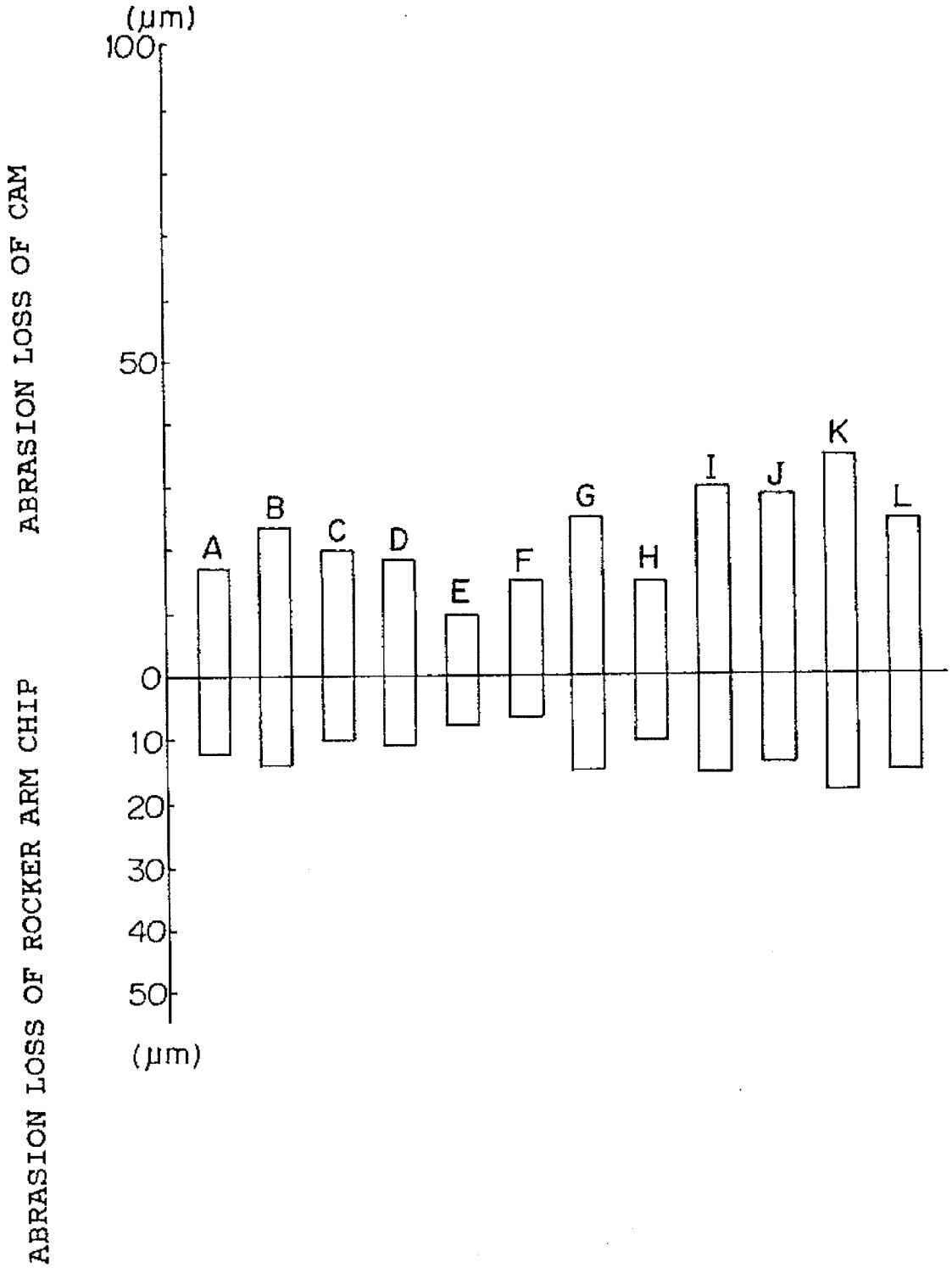
FIG. 2 is a graph representing a lig abrasion test result of camshafts as examples in experiment.

A lig abrasion test was performed to the camshaft of the Example 1 and a cam abrasion amount and an abrasion amount of a rocker arm as an object were measured with the following conditions. The measured result is shown in FIG. 2 by the capital A.

Lig Abrasion Test Conditions

Cam Revolution No.: 1000 rpm

Lubrication Oil: SAE10W-30

Oil Temperature: 80° C.

Spring Load: 200 kgf

Time: 200 hour

Object Rocker Arm Chip: Sintered Material

Experimental Examples 2–12

Camshafts were manufactured in a manner similar to that of the Experimental Example 1 except that compositions of molten baths, kinds of added elements and adding rates thereof were changed.

Compositions and cam hardnesses (HRC) of the camshafts thus manufactured are shown in the Tables 1 and 2.

Lig abrasion tests were performed to the camshafts of the Experimental Examples 2–12 in manners similar to that of the Experimental Example 1.

The experimental results are represented by capitals B-L in FIG. 2.

Metallic compositions of the camshafts of the Experimental Examples 2, 5, 6, 11 and 12 were photographed by means of electron microscope. FIGS. 4 to 8 are micro-structure photographs of the metallic compositions of the respective camshafts (nital solution corrosion, photographing magnitude 20 times, same in the other photographs). It will be seen from these microstructure photographs that the fine carbides (white portion) are dispersed in pearlite base (black portion).

Comparative Examples 1–5

Cast iron chilled camshafts were manufactured of conventional compositions shown in the Tables 1 and 2 by a usual method.

Compositions and cam hardness (HRC) are shown in the Tables 1 and 2.

Lig tests were performed to the thus manufactured camshafts in manners similar to that of the Experimental Example 1, and cam abrasion amounts and abrasion amounts of the object rocker arm chips were measured.

Figure 3:
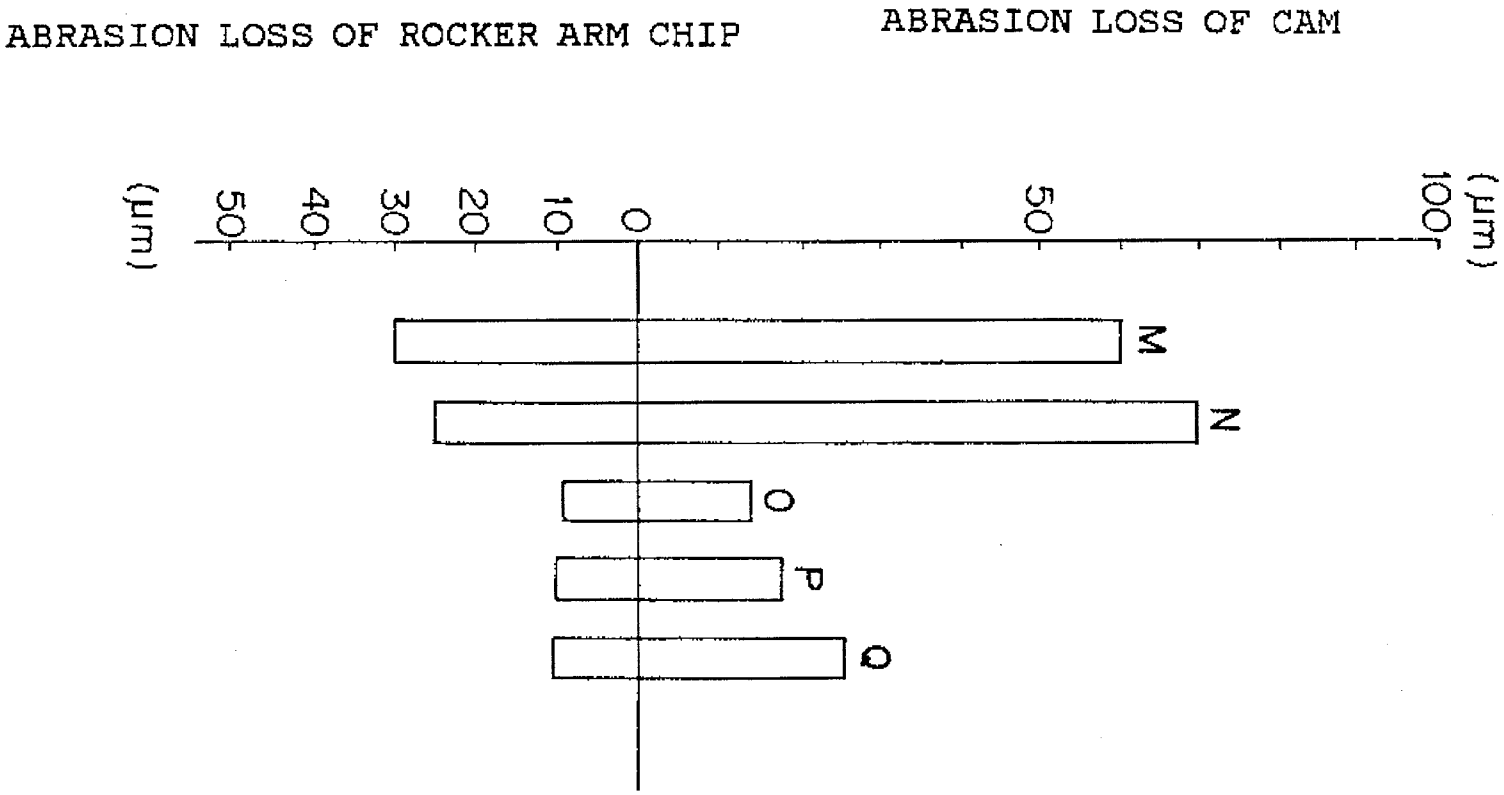
FIG. 3 is a graph representing a lig abrasion test result of camshafts as comparative examples.
Figure 4:
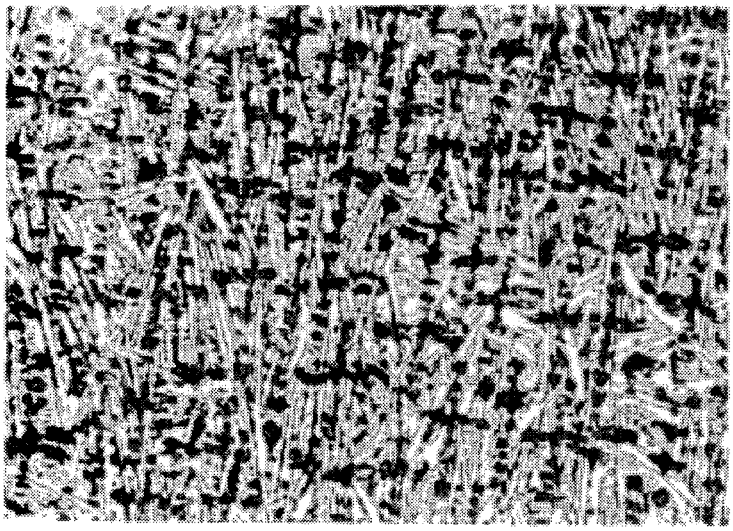
FIG. 4 is a photograph of microstructure of metal composition of the camshaft of the experimental example 2.
Figure 5:
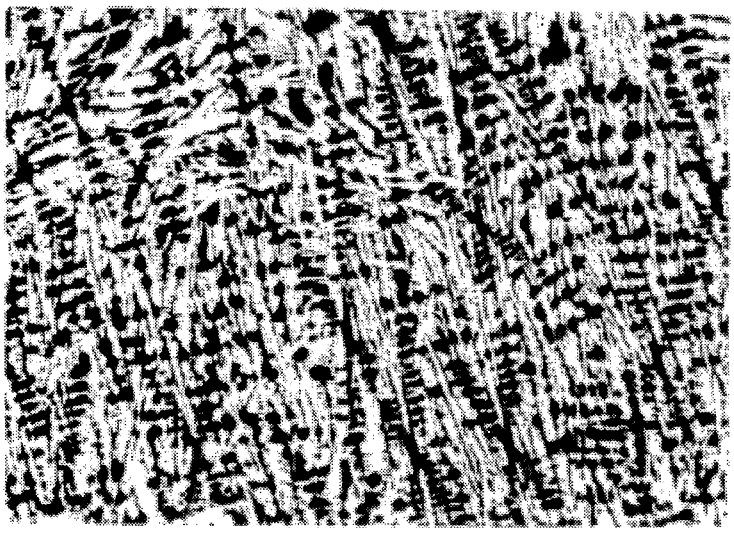
FIG. 5 is a photograph of microstructure of metal composition of the camshaft of the experimental example 5.
Figure 6:
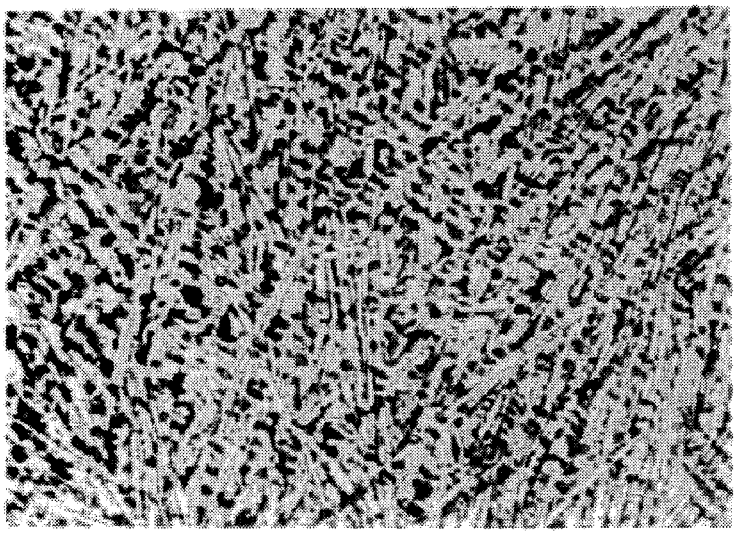
FIG. 6 is a photograph of microstructure of metal composition of the camshaft of the experimental example 6.
Figure 7:
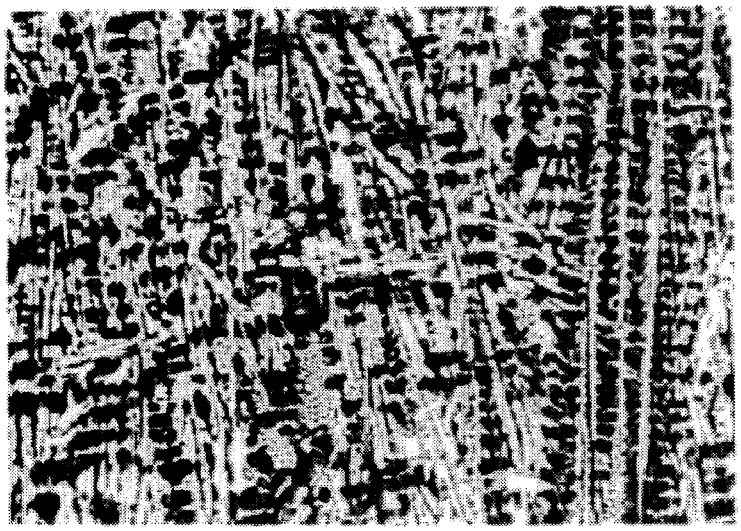
FIG. 7 is a photograph of microstructure of metal composition of the camshaft of the experimental example 11.
Figure 8:
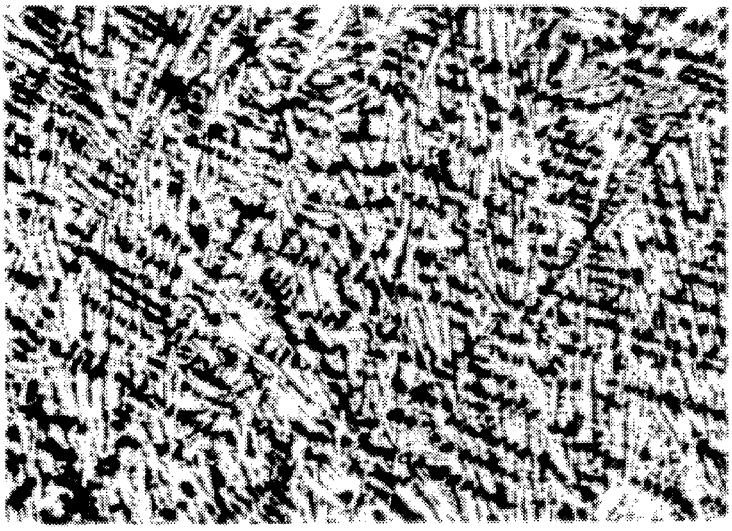
FIG. 8 is a photograph of microstructure of metal composition of the camshaft of the experimental example 12.

The measured results are shown by capitals M-Q in FIG. 3.

The metallic composition of the camshaft of the Comparative Example 1 was observed by the electron microscope and the photographing thereof was carried out in the same manner as that of the Experimental Example. The microstructure photograph thereof is shown in FIG. 9.

As can be seen from FIGS. 2 and 3, the camshafts of the Experimental Examples, in which the cast iron containing the specific element in the specific containing rate was chilled, was reduced in the cam abrasion amount and the abrasion amount of the object rocker arm chip in comparison with those of the conventional cast iron cam shaft, and it was thus confirmed that the abrasion resistant property can be remarkably improved and the superior scuffing resisting property can be also obtained because of no seizure.

Figure 9:
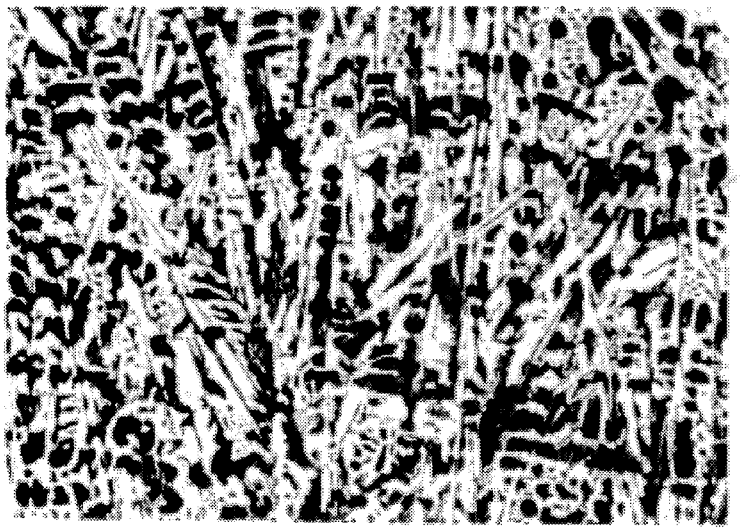
FIG. 9 is a photograph of microstructure of metal composition of the camshaft of the comparative example 1.

From the comparison of FIGS. 4–8 with FIG. 9, it was confirmed that, in the metallic composition (FIGS. 4–8) of the camshafts of the present invention, the fine carbide composition is dispersed in comparison with the metallic composition (FIG. 9) of the conventional camshaft.

Furthermore, the cast iron chilled camshaft of the Comparative Example 3 in which the content of Bi is 0.2 weight % exceeding 0.1 weight % did not provide a good workability of the journal portion. The camshaft of the Comparative Example 4 in which the content of Ni, as shown in FIG. 3, is 6.0 weight % exceeding 5.0 weight % exhibited the same abrasion amount as that of the Experimental Example (present invention) shown in FIG. 2, and from this fact, it was found that even if the content of Ni exceeds 5.0 weight %, any improved effect due to this content cannot be achieved, thus being disadvantageous in manufacturing cost.

TABLE 1

| | Composition (weight %) | | | | | | | |
|---|---|---|---|---|---|---|---|---|
| | C | Si | Mn | Ni | Cu | Co | Cr | Mo |
| Experimental Example 1 | 3.5 | 2.0 | 1.5 | 0.3 | — | — | 0.7 | 0.3 |
| Experimental Example 2 | 3.4 | 2.2 | 0.8 | — | — | — | 1.0 | — |
| Experimental Example 3 | 3.5 | 2.1 | 0.7 | — | — | — | 0.8 | — |
| Experimental Example 4 | 3.4 | 2.1 | 0.8 | — | — | — | 0.5 | 0.5 |
| Experimental Example 5 | 3.5 | 2.0 | 1.3 | 3.0 | — | — | 0.8 | 0.2 |
| Experimental Example 6 | 3.4 | 1.9 | 1.0 | — | 2.0 | — | 0.7 | — |
| Experimental Example 7 | 3.3 | 2.3 | 0.7 | — | — | 1.0 | 0.8 | — |
| Experimental Example 8 | 3.4 | 2.2 | 0.7 | 1.0 | — | 0.5 | 0.7 | 0.3 |
| Experimental Example 9 | 3.5 | 2.0 | 1.4 | 1.6 | — | — | 0.8 | 0.3 |
| Experimental Example 10 | 3.4 | 2.1 | 1.5 | 1.2 | 0.2 | — | 0.7 | 0.2 |
| Experimental Example 11 | 3.3 | 2.0 | 1.0 | 1.8 | — | — | 0.7 | 0.5 |
| Experimental Example 12 | 3.3 | 2.0 | 1.0 | 2.8 | — | — | 0.8 | 0.7 |
| Comparative Example 1 | 3.4 | 2.1 | 0.7 | 0.2 | — | — | 0.9 | 0.2 |
| Comparative Example 2 | 3.3 | 2.1 | 0.8 | — | — | — | 0.7 | 0.3 |
| Comparative Example 3 | 3.3 | 2.0 | 1.0 | 1.6 | — | — | 0.7 | 0.3 |
| Comparative Example 4 | 3.4 | 2.0 | 1.0 | 6.0 | — | — | 1.0 | 0.2 |
| Comparative Example 5 | 3.4 | 2.0 | 1.0 | — | 4.0 | 3.0 | 0.8 | 0.4 |

TABLE 2

| | Element Additive Rate (wt %) | Element Content (wt %) | Cam Hardness (HRC) |
|---|---|---|---|
| Experimental Example 1 | Bi 0.07 | Bi 0.03 | 56 |
| Experimental Example 2 | Te 0.03 | Te 0.01 | 55 |
| Experimental Example 3 | Se 0.05 | Se 0.02 | 56 |
| Experimental Example 4 | Bi 0.05<br>As 0.01 | Bi 0.02<br>As 0.005 | 56 |
| Experimental Example 5 | Bi 0.05 | Bi 0.02 | 59 |
| Experimental Example 6 | Bi 0.15<br>Sn 0.03 | Bi 0.05<br>Sn 0.02 | 58 |
| Experimental Example 7 | Te 0.015<br>Bi 0.03 | Te 0.005<br>Bi 0.01 | 54 |
| Experimental Example 8 | Bi 0.10<br>Sb 0.02 | Bi 0.04<br>Sb 0.01 | 57 |
| Experimental Example 9 | Te 0.002 | Te 0.0005 | 55 |
| Experimental Example 10 | Bi 0.002<br>Se 0.003 | Bi 0.0005<br>Se 0.001 | 54 |
| Experimental Example 11 | Bi 0.002 | Bi 0.0005 | 53 |
| Experimental Example 12 | Bi 0.005 | Bi 0.002 | 55 |
| Comparative Example 1 | no addition | — | 51 |
| Comparative Example 2 | no addition | — | 50 |
| Comparative Example 3 | Bi 0.70 | Bi 0.20 | 58 |
| Comparative Example 4 | Bi 0.03 | Bi 0.01 | 60 |
| Comparative Example 5 | Bi 0.05 | Bi 0.02 | 59 |

What is claimed is:

1. A camshaft including at least one cam lobe portion having a sliding surface, said camshaft comprising cast iron including at least one element in a total amount of 0.0001 to 0.1 wt. % from the group consisting of Bi, Te, Se, As, Sb and Sn, and chilled carbide along said sliding surface, said chilled carbide having an average grain diameter not greater than 15 μm.

2. The camshaft of claim 1, wherein the total amount of said at least one element is within a range of 0.001 to 0.1 wt. %.

3. The camshaft of claim 1, wherein said camshaft further includes at least one element in a total amount of 0.2 to 5.0 wt. % from the group consisting of Ni, Cu and Co.

4. The camshaft of claim 1, wherein not less than 40% of the sliding surface of the cam lobe portion contains said chilled carbide.

5. The camshaft of claim 1, wherein said sliding surface has a hardness not less than HRC 53.

* * * * *